US006831275B2

(12) United States Patent
Franzen et al.

(10) Patent No.: US 6,831,275 B2
(45) Date of Patent: Dec. 14, 2004

(54) NONLINEAR RESONANCE EJECTION FROM LINEAR ION TRAPS

(75) Inventors: Jochen Franzen, Bremen (DE); Gerhard Weiss, Weyhe (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 10/621,256

(22) Filed: Jul. 16, 2003

(65) Prior Publication Data

US 2004/0051036 A1 Mar. 18, 2004

(30) Foreign Application Priority Data

Aug. 8, 2002 (DE) ..... 102 36 346

(51) Int. Cl.[7] ..... H01J 49/00
(52) U.S. Cl. ..... 250/292; 250/282
(58) Field of Search ..... 250/292, 282, 250/281

(56) References Cited

U.S. PATENT DOCUMENTS 2,939,952 A 6/1960 Paul et al.
5,291,017 A 3/1994 Wang et al.
5,420,425 A 5/1995 Bier et al.
5,561,291 A 10/1996 Kelley et al.
6,297,500 B1 * 10/2001 Franzen et al. ..... 250/292

FOREIGN PATENT DOCUMENTS

GB 2 331 622 A 5/1999
WO WO 99/63578 A2 12/1999

OTHER PUBLICATIONS

Hager, James W., "A new linear ion trap mass spectrometer", Rapid Communications in Mass Spectrometry, vol. 16, John Wiley & Sons, Ltd., 2002, pp. 512–526.

Dawson, Peter H., "Quadrupole Mass Spectrometry and its applications", Elsevier Scientific Publishing Company, 1976 pp. 95–119.

* cited by examiner

*Primary Examiner*—Kiet T. Nguyen

(57) ABSTRACT

The invention relates to the mass-selective ejection of stored ions from linear ion traps. The invention consists in using nonlinear resonances to enhance the ejection speed.

20 Claims, 1 Drawing Sheet

NONLINEAR RESONANCE EJECTION FROM LINEAR ION TRAPS

FIELD OF INVENTION

The invention relates to the mass-selective radial or axial ejection of stored ions from linear ion traps.

BACKGROUND OF THE INVENTION

Linear quadrupole ion traps operate with an essentially quadrupolar radio-frequency field between four pole rods. The arrangement has been known since Wolfgang Paul; the basic principle is described in the same patent as the so-called "three-dimensional quadrupole ion traps" with ring and end caps (W. Paul and H. Steinwedel, DE 944 900; corresponding to U.S. Pat. No. 2,939,952). The basic arrangement which is often operated as a mass filter becomes a "linear ion trap" when rejecting fields are applied to the ends of the rod system, these being either DC voltage fields at the diaphragms or pseudo-potential fields as they appear in non-homogeneous radio-frequency fields. For example, pseudo-potential fields can be created by subsequent four-pole-rod systems Which are operated under different radio-frequency conditions.

(Comment on terminology: The term "linear ion trap" used here for rod systems has two meanings because a three-dimensional ion trap made up of ring and end-cap electrodes with an ideal quadrupole field is also termed "linear". In an ideal three-dimensional quadrupole field, the radio-frequency field strength increases linearly both radially and axially, and the repulsing pseudo-forces also increase linearly. This produces a harmonic oscillator. In contrast, traps with superimposed hexapole and octopole fields do not display a linear increase in the fields and are therefore also called "nonlinear ion traps". They form a non-harmonic oscillator and show the phenomenon called "nonlinear resonances". The ion traps made up of four pole rods, which are referred to here as a "linear ion trap", are sometimes called "two-dimensional traps" because the fields only change along two coordinates (x, y) and remain constant along the third coordinate (z). This explains the term "three-dimensional ion trap" for the trap with ring and endcaps, where the fields change in all three spatial coordinates. From the point of view of terminology, it would be better to make a distinction between "rod-system ion trap" and "ring-endcap system ion trap", but the term "linear traps" is now widely in use in the literature.)

A linear ion trap, as defined here, is disclosed in U.S. Pat. No. 5,420,425 (M. B. Bier and J. E. Syka, corresponding to EP 0 684 628 A1), operating with mass-sequential, radial ion ejection after dipolar resonance excitement through a slit in one of the pole rods. The mass spectra are scanned using a detector attached to the outside (or even two detectors outside two slits in opposing pole rods). The system is filled by injecting the ions into the rod system along the axis. Practically all the ions injected can be captured and stored—whereas in the case of the three-dimensional ion traps, only a few percent of the ions injected can be captured and stored. The advantages of an ion trap such as this are, firstly, that the filling behavior of the system is more efficient and, secondly, the spatial charge has much less influence on the ejection behavior—higher filling levels can be therefore used without any reduction in resolution by space charge. In comparison to three-dimensional ion traps, where in most cases several spectra have to be added in order to produce a high quality spectrum which can be evaluated well, with linear traps, one spectrum is sufficient. The disadvantages are that the parallel adjustment of the pole rods must be extremely accurate (which is not usually the case for three-dimensional ion traps), the electronics are very complex, and the scanning rate for mass spectra is not very high, which largely cancels out the advantage of only needing one scan spectrum.

An article, by J. W. Hager, "A new linear ion trap mass spectrometer", Rapid Commun. Mass Spectrom. 2002, 16, 512–526 disclosed a system using axial, mass-selective ejection of ions from a linear ion trap. In this case, use is made of the fact that, in the fringing field of the linear quadrupole field in front of a diaphragm on the exit side, the ions are not only able to oscillate radially but also axially. The axial oscillations are produced between the repelling DC potential of the diaphragm and the repelling pseudo-potential of the non-homogeneous fringing field within a small, flat potential well. These axial oscillations are now coupled with the radial oscillations due to the non-homogeneous shape of the potential surfaces in the fringing field; in other words, the two oscillation systems exchange energy. The energy passes from one oscillator system into the other and then back again. For example, if ions are excited to oscillate in the radial direction, they oscillate briefly in the radial direction, then oscillate briefly in the axial direction and then in the radial direction again, and so on. If the potential barrier at the front due to the diaphragms is not high, then radially excited ions will be able, during the first oscillation in the axial direction, to overcome this potential barrier and can be measured by a detector at the output. The oscillation can be excited by applying a radio-frequency voltage at one of the diaphragms. This is an excitation in the form of quadrupolar excitation.

The advantage of this method is again the efficient filling behavior of the linear ion trap by injecting ions from the end. The ejection yield is quoted to be 20%. That is significantly lower than for three-dimensional ion traps but, particularly with an improved filling rate of almost 100% and a somewhat larger storage, it is more than compensated for. However, the quantity of ions collected must not be as large as with the device for radial ejection described above if the ejection process is not to be inhibited by the spatial charge and, in particular, if the mass resolution is not to be reduced.

Around 1960, Wolfgang Paul and his then colleague, Friedrich von Busch, had already discovered the phenomenon of nonlinear resonances with quadrupole filters. Later, this phenomenon was mainly studied on three-dimensional quadrupole ion traps.

In three-dimensional quadrupole traps, where a radio frequency voltage is applied between the ring electrode and the two end-cap electrodes, ions can oscillate in an axial direction between the end caps and also in a radial direction parallel to the plane of the ring. The oscillations are sinusoidal with a mass-specific frequency of $\omega(m/z)$, and are called the fundamental oscillations or secular oscillations of the ions. On these slower sinusoidal oscillations are imposed the rapid oscillations $\Omega$ of the driving frequency, which is electrically applied at the ring electrode. According to the laws of trigonometry for the multiplication of two sinusoidal functions of different frequency, the multiplicative superimposition of sinusoidal oscillations leads to side bands with the main components $(\Omega-\omega)$ and $(\Omega+\omega)$ which, in this case, will be called Mathieu side bands because they appear as the solutions to the Mathieu differential equations for ion movement in the ion traps. Weaker components are $(2\Omega-\omega)$ and $(2\Omega+\omega)$, in general $(n\Omega-\omega)$ and $(n\Omega+\omega)$.

If higher multipole fields are superimposed on the quadrupole field due to electrical or mechanical distortions, overtones of the fundamental oscillation are produced, as is generally known for distorted oscillators. If the distortions are symmetric, the overtones produced are 3ω, 5ω and 7ω and so on, where ω is the fundamental oscillation of the ions. Asymmetric distortions produce all overtones 2ω, 3ω, 4ω, 5ω and 6ω and so on. Asymmetric distortions are obtained by superimposing higher multipole fields with odd numbers of pole pairs (such as hexapole and decapole fields) and symmetric distortions are obtained by superimposing multipole fields with even numbers of pole pairs (such as octopole and dodecapole fields).

Nonlinear resonances appear if the frequencies of the overtones match the Mathieu side-band frequencies. The energetic side-band frequencies, which arise from the voltage of the driving radio frequency of the ion trap, pump energy into the ions by exciting their oscillation overtones, just as a bell is made to vibrate by exciting its overtones. The oscillation amplitudes of the ions increase until the ions are eliminated from the ion trap, either by passing through apertures or by colliding with the electrodes.

A quadrupole field is also formed between the four pole rods of the linear ion trap. This field, however, only changes in two dimensions, while remaining constant along the axis of the pole rods (if the fringing fields at the ends of the rod systems are disregarded). The direction along the axis is called the z direction and the two directions between the two pairs of opposing rods are called the x and y directions. In a linear ion trap, the ions can oscillate in the x direction, the y direction or in both directions at the same time.

In the linear trap, it is also possible to produce overtones of ion oscillation by superimposing higher-order multipole fields. Mathieu side bands occur here as well. Here too, nonlinear resonances can be set up, as already discovered by Paul and Busch.

Different from three-dimensional ion traps, where superpositions of higher fields can only be achieved by mechanical distortions, the fields in linear ion traps can be distorted by mechanical means and by electrical means.

Mechanically caused field distortions arise, for example, by changes in the distance of individual pole rods from the center, by the use of cylindrical pole rods of different thicknesses or by hyperbolic pole rods with asymptotes which are not at right angles to one another. In particular, it is possible to generate a mathematically known mixture by mathematically simulating the equipotential surfaces of a desired superimposition of multipole fields. By using these mechanical means, it is possible to superimpose both "even" and "odd" multipole fields.

Electric field distortions are produced by changing the amplitude of the radio-frequency voltage of one pole rod relative to the voltage of the opposite pole rod. In this way, it is possible to produce superimpositions with "odd" multipole fields. In comparison to mechanical distortions, electrical distortions have the advantage that the strength of the superimposition with higher "odd" multipoles can be adjusted electronically, while mechanical distortions are not so easy to readjust to contain other components of higher multipoles. If the voltage at two opposing pole rods is altered in the same sense, then there is no superimposition with higher multipoles—only the axial potential in relation to the outside is superimposed by a component of the radio-frequency voltage.

SUMMARY OF THE INVENTION

The invention creates nonlinear resonance conditions by wilfully introduced distortions and exploits these nonlinear resonances advantageously for ion ejection as well in radial as in axial direction. The ejection in radial direction can thereby be made unidirectional.

A distortion of the essentially quadrupolar radio-frequency fields can be achieved by superimposing weak higher multipole fields, especially including higher odd multipole fields; either by disadjusting or reshaping the rod system mechanically, while keeping the rods strongly parallel, in particular by changing the distance between the individual rods and the center, or electrically by offsetting the radio frequency voltage at a particular rod.

It is possible to set up "even" multipole fields (such as octopole or dodecapole fields etc.) by symmetric distortion of the electric field in either the x or the y direction by mechanical means solely, and so-called "odd" multipole fields (such as hexapole or decapole fields etc.) by asymmetric distortions, produced as well by mechanical or by electrical means.

DETAILED DESCRIPTION

Figure 1:
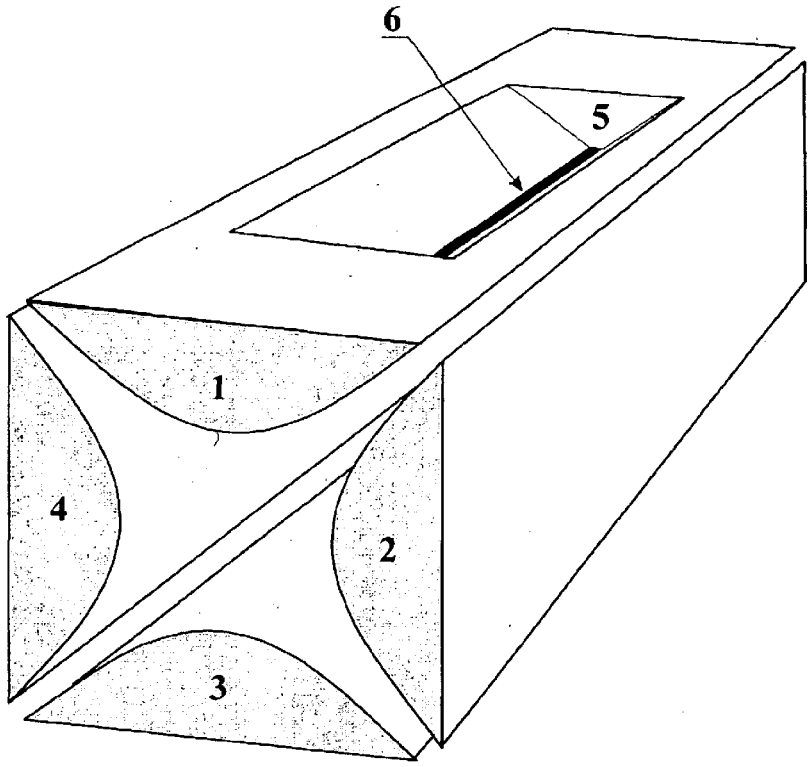
FIG. 1 shows a rod system ion trap with four hyperbolic pole rods (1, 2, 3 and 4) but without the apertured diaphragms on the front.

FIG. 1 shows an arrangement of four pole rods (1,2,3, and 4) where all four are at the same distance from the center. The pole rod (1) is hollowed out and has a recess (5) with a slit (6) in its floor through which the ions can be ejected from inside the rod system towards an ion detector (not shown). Higher multipole fields can be superimposed, and nonlinear resonances set up, by connecting an electrical voltage to pole rod (1) which is not the same as the voltages at the other pole rods, or by increasing the distance (not shown) between one or two adjacent pole rods and the axis.

The ions are injected into the system axially through diaphragms (not shown) on the front of the rod system. The ion trap is filled with a damping gas which decelerates the axial movement of the ions and also damps the radial oscillations until the ions have collected at the axis of the rod system in the form of a very thin ion thread. Ions of a selected mass-to-charge ratio m/z can then be brought to oscillate in a plane through the slit (6) and the central axis by exciting their fundamental frequency and, by increasing their oscillation, they can be ejected through the slit (6) towards an ion detector. The excitation is produced by an auxiliary AC voltage which is applied between the slit electrode (1) and the opposite electrode (3), in addition to the driving radio frequency, of which one phase is applied to the two rods (1) and (3) and the other phase is applied to the rods (2) and (4). The excitation AC frequency is smaller than the driving radio frequency since the fundamental frequencies of the ions amount to, at most, half the frequency of the driving frequency voltage. This ejection by dipolar voltage is relatively slow, therefore the invention enhances the ejection process by nonlinear resonances.

As explained above, it is possible to set up "even" multipole fields (such as octopole or dodecapole fields etc.) by creating symmetric distortions of the electric field in the x or y direction, while so-called "odd" multipole fields (such as hexapole or decapole fields etc.) can be set up by means of asymmetric distortions. "Odd" multipole fields can be produced by electrical means alone, but also by mechanically adjusting the pole rods or by using differently shaped pole rods. "Even" multipole fields need to be offset mechanically. Mixtures of electrical and mechanical means are also possible.

It is also possible to offset the system by a mixture of mechanical and electrical means in order to bring about superimpositions with higher multipole fields. For example, the "even" multipole fields can be generated by mechanical means such as increasing the distance of two opposing pole rods from the center, and "odd" multipole fields can be generated by changing the voltage at one of the pole rods.

Superimposing higher multipole fields produces sharply defined, nonlinear resonances. Oscillating ions of certain, sharply defined mass to charge ratios (m/z) are resonated by these nonlinear resonances, their oscillation amplitude increases and the ions leave the rod system. If the amplitude of the driving voltage (the radio-frequency voltage applied to the pole rods) is changed, then the nonlinear resonances resonate ions with other sharply defined m/z ratios. In this way, it is possible to eject all ions of sequential m/z values from the ion trap by changing the driving voltage—this is referred to here as scanning for masses.

The nonlinear resonance acts on an oscillating ion with an intensity which is proportional to the oscillation amplitude. If the ions are resting precisely at the axis of the rod system, which they have reached by their oscillations being damped by a collision or damping gas, then they are not subjected to nonlinear resonance because they possess no oscillation amplitude. The ions must therefore be "push-started" by superimposed dipolar electrical excitation before they can be resonated and ejected by the nonlinear resonance. However, the increase in amplitude due to the nonlinear resonance is much greater than that caused by resonant; dipolar excitation. While the resonant dipolar excitation causes a linear increase in amplitude, the increase caused by nonlinear resonance has the shape of a hyperbolic function which approaches one of its mathematical poles (rapidly approaching infinity). It is thus possible to achieve much shorter ejection periods, or in other words, a higher scanning rate for the same mass resolution.

It is therefore necessary to superimpose a dipolar excitation voltage with opposite phases on the radio-frequency voltage of two opposite pole rods which are normally supplied with the driving voltage in phase. It is favorable to select this dipolar excitation voltage precisely at the frequency of the nonlinear resonance. Most of the non-linear resonance frequencies amount to small integer ratios of the driving frequency, e.g., to ⅓ or ¼ of the driving frequency. It is therefore also favorable to lock the dipolar excitation frequency with the frequency of the driving radio-frequency voltage. It is favorable again to make the phases between the two voltages adjustable with respect to each other in order to provide the optimum "push-start" to move the ion oscillation into nonlinear resonance.

When higher "odd" multipoles are superimposed, the oscillation frequency of the ions, together with the amplitude, shifts toward smaller frequencies. With three-dimensional ion traps, this has proved to be disadvantageous for a mass-sequential ejection of ions due to the increase in the driving voltage. It is therefore advisable to simultaneously superimpose "even" higher multipole fields, having the same polarity as the basic quadrupolar field, as well. This superposition has the beneficial effect of producing a contrary dependence of the oscillation frequency on the oscillation amplitude, thus compensating the shift in resonance frequency.

The optimum degree of superimposition with higher multipoles depends on the scanning rate, i.e., the rate at which sequential masses are ejected. It is therefore advantageous to couple the degree of superimposition with the scanning rate.

For example, if a single pole rod is mounted further away from the center than the remaining three pole rods, and if the two phases of a radio-frequency voltage are applied to the pole rods crosswise, then higher "odd" multipoles are superimposed and, for the oscillations in the direction toward the pole rod which has been offset, overtones are formed, where $2\omega$ is the strongest overtone. If the $2\omega$ overtone meets the $\Omega-\omega$ side band fulfilling the condition $2\omega=\Omega-\omega$ or $\omega=\Omega/3$, a strong nonlinear resonance is produced. The fundamental oscillation $\omega$ of the ions assume, in this nonlinear resonance, a frequency which is exactly one third of the frequency of the driving radio frequency voltage $\Omega$ applied to the pole rods. (It is interesting to see, if we study the behavior of all nonlinear resonance conditions and all overtones, that in the nonlinear resonance case, other overtones meet other side bands at exactly the same conditon.)

The condition $\omega=\Omega/3$, achieved at a certain amplitude of the driving voltage, applies only to ions of a sharply defined mass-to-charge ratio. This ion species therefore absorbs energy, the amplitude of the oscillation increases in the direction towards the pole rod which has been offset and the ions are ejected. The ejection is assymmetric, the ions hit only one of the opposing pole rods. If there is a slit in the pole rod, then some of the ions escape from the storage area through the slit and can be detected outside as an ion beam. If the driving voltage is changed, then ions of another mass-to-charge ratio will escape. The entire mass spectrum for the stored ions can be recorded by scanning the driving voltage. (The mass spectrum is defined as a plot of the ion-beam intensities against the mass-to-charge ratios m/z of the ions).

If the ions are to be resonated by the nonlinear resonance, then they must already be oscillating with a finite amplitude. The nonlinear resonance acts on an oscillating ion to a degree which is proportional to the oscillation amplitude (although not linearly proportional). If the ions are resting precisely at the axis of the rod system, which they have reached by their oscillations being damped by a collision or damping gas, then they are not subjected to this nonlinear resonance because they have no oscillation amplitude.

The ions must therefore be "push-started" by superimposing a dipolar electrical excitation before they can be resonated and ejected by the nonlinear resonance. The excitation must be in the direction of the nonlinear resonance, i.e., between two pole rods which are normally only connected to the same phase of the driving voltage. However, the increase in amplitude due to a nonlinear resonance is much greater than that caused by resonant, dipolar excitation. While the resonant, dipolar excitation produces a linear increase in amplitude, the increase produced by nonlinear resonance has the shape of a hyperbolic function which approaches one of its mathematical poles. It is possible to achieve much shorter ejection periods, or in other words, a higher scanning rate for the same mass resolution.

It is then necessary to superimpose an excitation voltage in phase opposition on the radio-frequency voltage of two opposite pole rods which are normally connected to the same phase of the driving voltage.

This dipolar excitation voltage can be selected with exactly the same frequency as the nonlinear resonance, in our example, at Ω/3. In this case, it is advisable to lock the frequency of this voltage to the frequency of the driving radio-frequency voltage. However, the phases between the two voltages must be adjustable in order to provide the optimum "push-start" for moving the ion oscillation into nonlinear resonance.

The dipolar excitation voltage can also have a frequency which is assumed by the ions as the fundamental oscillation for a mass scan (generally a somewhat higher frequency) shortly before reaching the nonlinear resonance. In our example, this is a frequency which is somewhat higher than Ω/3. The ions then absorb energy shortly before reaching the nonlinear resonance and increase their oscillation amplitude. On reaching the nonlinear resonance, they are resonated by it and ejected.

A favorable embodiment of the invention does not supply both phases of the RF driving voltage to the two pairs of opposing pole rods. Instead, only a single phase of the rf voltage is used and fed to the pair of rods which are not used for ion ejection. In this case, the rod containing the slit can be held near ground potential, favorable for ion detection in the detector. The dipolar excitation voltage for the "push-start" can be fed solely to the rod opposing the rod with the slit. Of course, feeding the ions to the rod system requires a symmetric connection to the two phases of the rf driving voltage, so a switching process becomes necessary.

When higher "odd" multipoles are superimposed, the oscillation frequency of the ions shifts towards lower frequencies depending on the amplitude. With three-dimensional ion traps, this has proved to be disadvantageous for a mass-sequential ejection of ions by increasing the driving voltage. It is therefore advisable to also superimpose higher "even" multipoles with a polarity that produces a contrary dependence of the oscillation frequency on the oscillation amplitude. In the case of higher "even" multipoles, this depends on whether the fields which are to be superimposed are positive or negative. If the superimposition is selected so that the increase in the field is progressively weaker from the center outwards, then the oscillation frequency of the ions will decrease with increasing amplitude. The effect of superimposing "odd" multipoles is therefore counterbalanced.

Mechanically, such a superpositon of a hexapole and a octopole field can be achieved by enlarging the distance of the slit-carrying rod from the center of the rod system by an amount d, and enlarging the distance of the opposing rod by an even larger amount. Other shapes are possible, e.g., making the slit-carrying rod and its opponent smaller in rod diameter, the slit-opposing rod even smaller than the slit-carrying rod.

The optimum degree of superimposition with higher multipoles depends on the scanning rate, i.e., the rate at which sequential masses are ejected. For optimum mass resolution in each case, therefore, the degree of superimposition with multipoles must be selected in relation to the scanning rate. For electrically generated superimpositions, this is easy, but for mechanically generated superimpositions it is more difficult.

Figure 2:
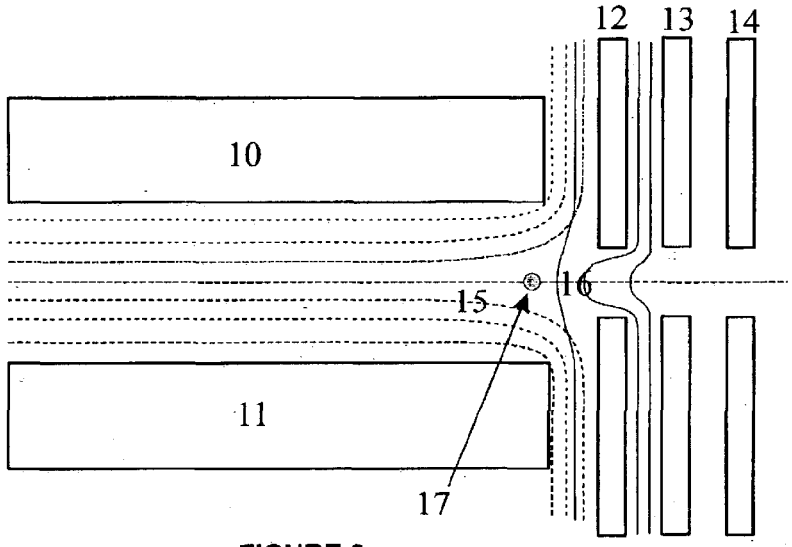
FIG. 2 shows the fringing field of a rod system consisting of four pole rods (10 and 11) with three apertured diaphragms on the front (12, 13 and 14). Ions (17) are collected in the fringing field and can be ejected axially by the coupled action of radial and axial oscillations.

There is a major difference between operating linear ion traps with axial ejection and operating them with radial ejection. In both systems, the movement of ions is decelerated by a damping gas, but for axial ejection, the ions are not collected along the whole of the axis of the rod system but only within a small potential trough located at the end of the rod system. FIG. 2 shows the ion cloud which collects here. This potential trough is formed, on the one hand, by a DC voltage potential increase (16) due to slight countervoltages at the diaphragms (12 and 13) and, on the other hand, by an increase in the pseudo-potential of the radio-frequency fringing field (15) toward the inside of the rod system (10 and 11).

Here too, nonlinear resonances can accelerate axial ejection of ions from the front of the rod system. On the one hand, the axial oscillation of the ions between the DC field (16) at the front apertured diaphragms (12, 13 and 14) and the axial component of the pseudo-potential fringing field (15) is already significantly asymmetric, and therefore sure to display overtones. On the other hand, oscillations in the frequency of the driving voltage are impressed on the ion oscillation by the driving voltage. In this case too, the overtones coincide with the side bands of the ion oscillations. If a radio frequency at one of the diaphragms at the front push-starts the oscillations so far that the ions are collected by the nonlinear resonances, then these ions are ejected axially through the apertured diaphragms via the DC potential connected to the diaphragms.

A superimposition of higher multipoles on the rod system produced by either mechanical and electrical means generates nonlinear resonances in a radial direction; in other words, either in the x or the y direction. However, the quadrupolar excitation must now be replaced by a dipolar excitation in this direction also. Dipolar excitation can be produced by using a split diaphragm at the end of the rod system, the two phases of the dipolar excitation voltage being applied to the two half diaphragms (in addition to an optimum DC voltage at both half diaphragms). The half diaphragms can be attached directly to the front surface of the rod system, but can also be separated from the rod system by one or more apertured diaphragms.

By superimposing higher "even" multipoles with a polarity such that they also have the effect of reducing the oscillation frequency with increasing oscillation amplitude, it is possible for the increase in oscillation amplitude to be restricted relatively sharply by extinguishing the resonance. Dipolar "push starting" of the oscillations causes the oscillation amplitude to jump rapidly to this limit. By coupling with the axial oscillations, the energy is then transferred to the latter and the ions can leave the rod system by overcoming the potential barrier. In this way, no ions are lost by colliding with the pole rods due to the nonlinear resonance.

In a similar way, nonlinear resonances can also accelerate the axial ejection of ions from the front of the rod system. Firstly, the axial oscillation of the ions between the DC field at the front apertured diaphragms and the axial component of the pseudo-potential fringing field is already considerably asymmetric, i.e., "odd" higher multipole fields are superimposed. Secondly, oscillations in the frequency of the driving voltage are impressed on the ion oscillation by the driving voltage. Thus, here too, the overtones can coincide with the side bands of the ion oscillations. If these oscillations are push-started by a radio frequency at one of the front-end diaphragms to such an extent that the ions are resonated by the nonlinear resonances, then these ions are ejected axially through the apertured diaphragms via the DC potential applied to the diaphragms. Not even a coupling with radial oscillations is necessary for this to happen.

However, the nonlinear resonance can also be exploited to couple radial oscillations with axial oscillations. Superimposing higher multipoles at the rod system by either mechanical or electrical means produces nonlinear resonances in a radial direction, in other words, in either the x or the y direction. The quadrupolar excitation must now be replaced by dipolar excitation. Dipolar excitation can be produced by using a split diaphragm at the end of the rod system, the two phases of the dipolar excitation voltage being applied to the two half diaphragms (in addition to the optimum DC voltage at both half diaphragms). The half diaphragms can be attached directly to the front surface of the rod system, but can also be separated from the rod system by one or more apertured diaphragms.

What is claimed is:

1. Method of analyzing ions using a quadrupole ion trap having four pole rods and a field frequency Ω, the method comprising:

(a) introducing ions into the quadrupole ion trap;

(b) mass selectively ejecting ions from the quadrupole ion by superimposing higher multipole fields on the field of the ion quadrupole trap that result in nonlinear resonances; and (c) detecting the ejected ions.

2. Method according to claim 1 wherein the ejection of the ions is started by a dipolar excitation of frequency ω, where ω is an integer fraction of the frequency Ω or a small multiple thereof.

3. Method according to claim 2 wherein the frequency ω is equal to Ω/3.

4. Method according to claim 2 wherein the phase of the dipolar excitation is locked to the phase of the field of the ion quadrupole trap, and wherein the phases are adjustable in relation to one another.

5. Method according to claim 2 wherein the dipolar excitation is partially or entirely generated by splitting an apertured diaphragm on the front of the pole rods and applying a voltage of frequency ω to each half of the diaphragm.

6. Method according to claim 1 wherein the higher multipole fields comprise higher "odd" multipole fields and/or higher "even" multipole fields.

7. Method according to claim 6 wherein the higher multipole fields comprise at least a hexapole field and an octopole field.

8. Method according to claim 6 wherein the higher multipole fields are generated by dislocating the arrangement of the pole rods.

9. Method according to claim 8 wherein amplitudes of the additional voltages applied to pole rods are adjusted to the scanning rate.

10. Method according to claim 6 wherein the higher multipole fields are generated by shaping pole rods asymmetrically.

11. Method according to claim 6 wherein the higher multipole fields are generated by applying additional voltages of frequency Ω to the pole rods.

12. Method according to claim 1 wherein the ions are ejected orthogonally and/or axially to the pole rods.

13. Method according to claim 1 wherein the quadrupole ion trap is filled with a damping gas prior to the mass selective ejection.

14. An ion analysis apparatus comprising:

a quadrupole ion trap, having four pole rods and a field with a frequency Ω, into which ions are introduced;

an ion ejection system that selectively ejects ions from the ion trap by superimposing higher multipole fields on the field of the ion trap that result in nonlinear resonance; and a detector for detecting ions ejected from the ion trap.

15. An ion analysis apparatus according to claim 14 wherein the ion ejection system starts ejection of the ions by a dipolar excitation of frequency ω, where ω is an integer fraction of Ω or a small multiple, thereof.

16. An ion analysis apparatus according to claim 15 wherein the frequency ω is equal to Ω/3.

17. An ion analysis apparatus according to claim 15 wherein the phase of the dipolar excitation is locked to the phase of the field of the ion quadrupole trap, and wherein the phases are adjustable in relation to one another.

18. An ion analysis apparatus according to claim 14 wherein the higher multipole fields are generated by shaping pole rods asymmetrically.

19. An ion analysis apparatus according to claim 14 wherein the higher multipole fields are generated by dislocating the arrangement of the pole rods.

20. An ion analysis apparatus according to claim 14 wherein the higher multipole fields are generated by applying additional voltages of frequency Ω to the pole rods.

* * * * *